United States Patent [19]

Herrington

[11] Patent Number: 4,913,560

[45] Date of Patent: Apr. 3, 1990

[54] STRETCHY STICKY TAPE BAG TIE CLOSURE

[75] Inventor: Fox J. Herrington, Holcomb, N.Y.

[73] Assignee: Mobil Oil Corporation, New York, N.Y.

[21] Appl. No.: 320,448

[22] Filed: Mar. 8, 1989

[51] Int. Cl.[4] ..... B65D 33/28

[52] U.S. Cl. ..... 383/71; 24/30.5 R; 206/813; 427/208.8; 428/41

[58] Field of Search ..... 24/30.5 T, 30.5 R; 427/208.8; 383/71; 206/813; 428/40, 41

[56] References Cited

U.S. PATENT DOCUMENTS

| | | | |
|---|---|---|---|
| 2,088,232 | 7/1937 | Cumming | 383/71 |
| 3,006,793 | 10/1961 | Wheeler | 428/41 |
| 3,035,957 | 5/1962 | Morgan | 428/41 |
| 3,322,325 | 5/1967 | Bush | 24/30.5 R |
| 3,412,926 | 11/1968 | Bostwick | 383/71 |
| 4,008,851 | 2/1977 | Hirsch | 206/813 |
| 4,264,662 | 4/1981 | Taylor et al. | 428/40 |
| 4,528,226 | 7/1985 | Sweeney | 428/40 |
| 4,813,794 | 3/1989 | Herrington | 383/75 |

FOREIGN PATENT DOCUMENTS

| | | | |
|---|---|---|---|
| 2173770 | 10/1986 | United Kingdom | 383/71 |

*Primary Examiner*—Stephen P. Garbe
*Attorney, Agent, or Firm*—Alexander J. McKillop; Charles J. Speciale

[57] ABSTRACT

A tape is made of plastic with high elongation, then is coated on one or both sides with pressure-sensitive adhesive. The adhesive is then coated with a brittle coating material. In use, the tape is manually stretched, causing the brittle coating to crack and separate, exposing the adhesive. The tape is then wrapped around the neck of a bag to effect a closure.

7 Claims, 1 Drawing Sheet

STRETCHY STICKY TAPE BAG TIE CLOSURE

FIELD OF THE INVENTION

The present invention relates to bag tie closures for flexible wall bags having a flexible top and particularly to a sticky tape bag closure for thermoplastic bags and method of manufacture.

BACKGROUND OF THE INVENTION

Bags made of thin polyethylene material have been used in various sizes. Small bags are used in packaging of sandwiches and the like, medium size bags are used for garbage and kitchen trash and larger bags are used for other types of trash such as lawn clippings and leaves. Bags of this type generally include a front wall and back wall and are seamed up the sides with an open top. The top is adapted to be closed by twisting and maintained closed by a suitable tie strip or string. The present invention is particularly concerned with a novel bag tie closure for thermoplastic bags. In the past, thermoplastic bags have been provided with various types of tie strips. In some instances the tie strips have been separate strips adapted to be wrapped around the neck of the bag, such strips having openings and notches thereon to effect a closure of the strip around the neck of the bag. In other instances a flat tie strip has been secured to the top of the bag by an adhesive patch so that the tie strip can be removed from the bag and wrapped around the neck of the bag after it has been filled to effect closure of the bag. In other instances, the neck of the bag has been closed by sticky tape and in other instances the bags have been closed by banding the neck of the bag with adhesive. While these various techniques of closing the neck of the bag have been used successfully, they have left something to be desired.

RELATED APPLICATIONS

The present invention is related to the invention disclosed in Herrington et al application Serial No. entitled "Corrugated Sticky Tape Bag Tie Closure", Attorney Docket MEP-12 (MP-88-P-32) assigned to the assignee of the present application and concurrently filed herewith. Other related applications directed to draw tape bags include the invention disclosed in Herrington application Ser. No. 195,920 entitled "Draw Tape Bag Held Closed by Microencapsulated Adhesive" filed May 19, 1988, the invention disclosed in Herrington et al application Ser. No. 195,919 entitled "Thermoplastic Draw Tape Bag with Tacky Closure Surface" filed May 19, 1988, and the invention disclosed in Herrington application Ser. No. 195,921 entitled "Thermoplastic Draw Tape Bag with Tacky Tape" filed May 19, 1988, all assigned to the assignee of the present application. It is an object of the present invention to provide a stretchy sticky bag tie closure for closing the neck of the bag wherein the adhesive coating on the bag tie is not exposed during handling of the bag and is only exposed after the bag tie is stretched and wrapped around the neck of the bag to effect closure.

SUMMARY OF THE INVENTION

In accordance with the present invention there is provided a stretchy sticky tape bag tie closure for closing the neck of the bag. The bag tie closure comprises a tape of plastic material having high elongation, the tape being coated at least one side with a pressure-sensitive adhesive, the adhesive being coated with a brittle coating material so that when the tape is manually stretched causing the brittle coating to crack and separate thereby exposing the adhesive so that when the tape is wrapped around the neck of the bag the adhesive is secured to the bag and to the adjacent surface of the tape to effect a closure of the bag. In accordance with one aspect of the invention the tape is made of a high density polyethylene with minimum orientation, in the lengthwise direction, the tape is coated on both sides with an aggressive pressure-sensitive adhesive and the adhesive is coated with a non-extensible coating so that the adhesive is not exposed until the tape is stretched.

In accordance with another aspect of the invention there is provided a thermoplastic bag in combination with a stretchy sticky tape bag tie closure. The thermoplastic bag has two panels forming an open top closed bottom bag, the panels being joined along the sides of the bag, a stretchy sticky tape bag tie closure is secured at one end to one of the sides of the bag adjacent the open top thereof, the stretchy sticky bag tie closure comprises a tape of plastic material having high elongation, the tape being coated on both sides with pressure-sensitive adhesive and the adhesive being coated with a brittle coating material so that when the tape is manually stretched, causing the brittle coating to crack and separate, exposing the adhesive, the tape can be wrapped around the neck of the bag to effect a closure.

In accordance with another aspect of the invention there is provided a method of making a stretch sticky tape bag tie closure for closing the neck of a bag. The method comprises the steps of applying to at least one side of a tape of plastic material having high elongation in the lengthwise direction a coating of pressure-sensitive adhesive and thereafter coating the adhesive with a brittle coating material so that when the tape is manually stretched causing the brittle coating to crack and separate thereby exposing the adhesive so that when the tape is wrapped around the neck of the bag, the adhesive is secured to the bag and to the adjacent surface of the tape to effect a closure of the bag.

The foregoing and other objects, features and advantages of the invention will be more apparent from the following detailed description and appended claims.

DESCRIPTION OF THE PREFERRED EMBODIMENT

Figure 1:
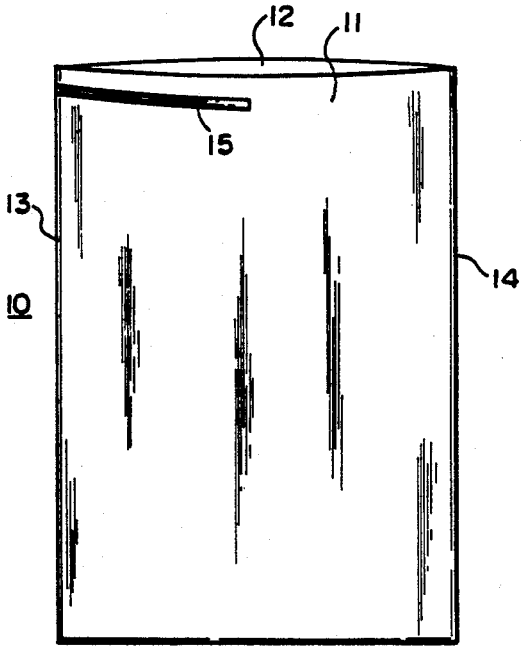
FIG. 1 shows a thermoplastic bag having a stretchy sticky tape bag tie closure embodying the present invention.
Figure 4:
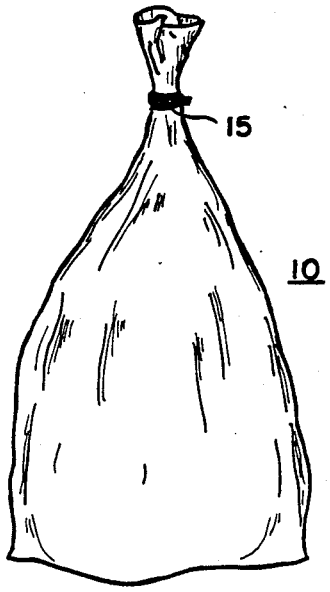
FIG. 4 is a perspective view of a thermoplastic bag similar to FIG. 1 having a stretchy sticky tape bag tie closure wrapped around the neck of the bag to effect closure of the bag.
Figure 2:
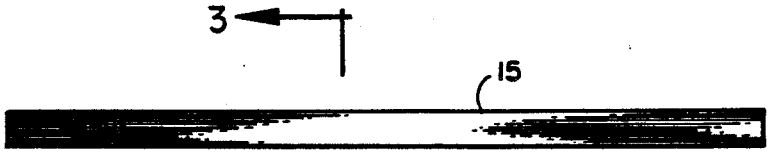
FIG. 2 is a plan view of a stretchy sticky tape bag tie closure embodying the present invention.
Figure 3:
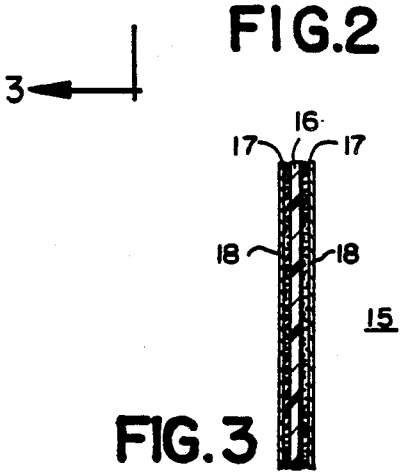
FIG. 3 is a sectional view taken along the lines 3—3 in FIG. 2.

As shown in FIG. 1, the thermoplastic bag 10 includes a front panel 11 and a rear panel 12. The two panels are formed from an extruded tube of polyethylene or other suitable plastic material with a slit along the side to form an open top. The sides of the panels 11 and 12 are heat sealed at 13 and 14 and cut from the tube in a perpendicular direction. As thus far described, bags of this type are well known in the art. As may be seen in FIG. 1, a stretchy sticky tape bag tie closure 15 embodying the present invention has one end thereof secured to the edge 13 adjacent the top of the bag 10. The structure of the bag tie closure 15 shown in FIGS. 1 and 2 is more clearly illustrated in the cross-sectional view of FIG. 3. As shown in FIG. 3 the bag tie closure 15 is provided with a center tape of plastic material 16. The plastic tape 16 has a high elongation such for example as a high density polyethylene with minimum orientation in the lengthwise direction of pull. Both sides of the tape 16 are coated with an aggressive pressure-sensitive adhesive and the adhesive coatings 17 are in turn coated with a brittle coating material 18. The brittle coating material has the characteristic that when the tape 16 is stretched, it causes the brittle coating 18 to crack and separate thereby exposing the adhesive 17 so that when the tape is wrapped around the neck of the bag, the adhesive is secured to the bag and to the adjacent surfaces of the tape to effect a closure of the bag as shown in FIG. 4. The brittle coating 18 is a non-extensible coating comprising a lacquer or lacquer base. In one example of the invention the tape was made from a 1-mil film made of Phillips TR-130 medium density polyethylene resin, coating it by applying a pressure-sensitive 3-M spray adhesive and then coating the adhesive with a machinist's blue dye having a lacquer base. It will be understood that the tape material is not limited to polyethylene film but may comprise other thermoplastic materials having the characteristic of high elongation and extensibility so that the tape can be stretched a substantially long distance before it breaks and thus insure that the brittle coating material will crack and leave a space between the cracks so that the pressure-sensitive adhesive will be exposed.

What is claimed is:

1. A stretchy sticky tape bag tie closure for closing the neck of a bag comprising a tape of plastic material having high elongation, the tape being coated on at least one side with a pressure-sensitive adhesive, the adhesive being coated with a brittle coating material so that when the tape is manually stretched causing the brittle coating to crack and separate thereby exposing the adhesive so that when the tape is wrapped around the neck of the bag the adhesive is secured to the bag and to the adjacent surface of the tape to effect a closure of the bag.

2. A stretchy sticky tape bag tie closure according to claim 1 wherein said tape is made of a high density polyethylene with minimum orientation in the lengthwise direction, the tape is coated on both sides with an aggressive pressure-sensitive adhesive and the adhesive is coated with a non-extensible coating.

3. A stretchy sticky tape bag tie closure according to claim 2 wherein the non-extensible coating comprises a lacquer.

4. A thermoplastic bag having a stretchy sticky tape bag tie closure comprising a thermoplastic bag having two panels forming an open top, closed bottom bag, said panels being joined along the sides of said bag, and a stretchy sticky tape bag tie closure secured at one end to one of the sides of said bag adjacent the open top thereof said stretchy sticky tape bag tie closure comprising a tape of plastic material having high elongation in the lengthwise direction, the tape being coated on both sides with pressure sensitive adhesive and the adhesive being coated with a brittle coating material so that when the tape is manually stretched, causing the brittle coating to crack and separate, exposing the adhesive, the tape can be wrapped around the neck of the bag to effect a closure.

5. The method of making a stretchy sticky tape bag tie closure for closing the neck of a bag comprising the steps of applying to at least one side of a tape of plastic material having high elongation a coating of pressure-sensitive adhesive and thereafter coating the adhesive with a brittle coating material so that when the tape is manually stretched causing the brittle coating to crack and separate thereby exposing the adhesive so that when the tape is wrapped around the neck of the bag, the adhesive is secured to the bag and to the adjacent surface of the tape to effect a closure of the bag.

6. The method of making a stretchy sticky tape bag tie closure according to claim 5 wherein the tape is made of a high density polyethylene with minimum orientation in the lengthwise direction, the tape is coated on both sides with an aggressive pressure-sensitive adhesive and the adhesive is coated with a non-extensible coating.

7. The method of making a stretchy sticky tape bag tie closure according to claim 6 wherein the non-extensible coating comprises a lacquer.

* * * * *